United States Patent [19]

Koon, Jr.

[11] 4,314,419

[45] Feb. 9, 1982

[54] RIFLE MAGAZINE DEVICE

[75] Inventor: Homer E. Koon, Jr., Carrollton, Tex.

[73] Assignee: Alpha Arms, Inc., Dallas, Tex.

[21] Appl. No.: 101,276

[22] Filed: Dec. 7, 1979

[51] Int. Cl.[3] ..... F41C 25/02

[52] U.S. Cl. ..... 42/50

[58] Field of Search ..... 42/50, 18, 22

[56] References Cited

U.S. PATENT DOCUMENTS

| | | | |
|---|---|---|---|
| 1,306,972 | 6/1919 | Nelson | 42/50 |
| 1,331,155 | 2/1920 | Johnson | 42/50 |
| 2,434,269 | 1/1948 | Harvey | 42/50 |
| 2,715,290 | 8/1955 | Harvey | 42/50 |
| 2,903,809 | 9/1959 | Stoner | 42/50 |

*Primary Examiner*—Charles T. Jordan

*Attorney, Agent, or Firm*—H. Mathews Garland

[57] ABSTRACT

A rifle having a stock, a receiver, a barrel, a trigger assembly, a magazine, and stock inserts forming mounting blocks for supporting the receiver in the stock. The magazine is a removable integral sheet metal member with inwardly turned longitudinal retainer flanges along the top rear edges of the side walls, a vertical internal retainer boss along each side wall spaced forwardly from the retainer flanges, cartridge case loading ramp edge surfaces along the top edge of each of the side walls of the magazine spaced from the longitudinal retainer flanges, and internal stops on the side walls for limiting the upward movement of a follower within the magazine. The stock inserts are longitudinally spaced mounting blocks having upper cylindrical surface portions fitting the cylindrical surface of the bottom of the receiver along the forward and back ends of the receiver and rectangular side, bottom, and end surfaces for mounting the stock inserts in rectangular cavities in the rifle stock.

7 Claims, 16 Drawing Figures

RIFLE MAGAZINE DEVICE

This invention relates to improvements in riles and more specifically relates to a rifle magazine.

In many present rifle designs the receiver includes cartridge rails and loading ramps which must be hand cut into the receiver. The use of hand labor for forming the rails and loading ramps in rifle receivers is expensive and less accurate than similar apparatus which permits the features of the rifle affecting the feeding of the cartridges into the receiver made in accordance with invention. It is therefore desirable to improve existing rifles by reducing manufacturing costs and upgrading performance.

It is a particularly important object of the present invention to provide a new and improved magazine box.

It is another object of the invention to provide a magazine box in a rifle which does not have to be hand formed in the receiver of the rifle.

It is another object of the invention to provide a rifle magazine box which is formed of sheet material such as metal and inserted as a separate part into the rifle.

It is another object of the invention to provide a rifle magazine box which has retaining flange and guide surface means coacting with each cartridge case thereby eliminating damage which frequently occurs to bullets while loading in existing rifle designs.

In accordance with the invention there is provided a magazine box for a rifle which is an integral sheet metal member having parallel opposite side walls and parallel opposite end walls perpendicular to the side walls, cartridge case retainer flanges along the upper edges of the rear portions of the side walls, inwardly deformed vertical portions along the side walls defining a retainer surface engageable with the shoulders on the necks of cartridge cases, upwardly sloping forwardly extending guide surfaces along the upper edges of each of the opposite sides of the magazine spaced forwardly from the cartridge case retainer flanges beginning at the retainer shoulder of each of the inwardly deformed side wall portions and spaced below the cartridge case retainer flanges on the side walls, and inwardly projecting retainer tabs on each of the side walls for limiting the upward movement of a follower within said magazine, and the opposite end walls having concave top edge surfaces permitting the magazine to fit along a cylindrical bottom surface of a rifle receiver.

The foregoing objects and advantages and the specific details of the invention will be better understood from the following description of a preferred embodiment of the invention taken in conjunction with the accompanying drawings wherein.

Figure 1:
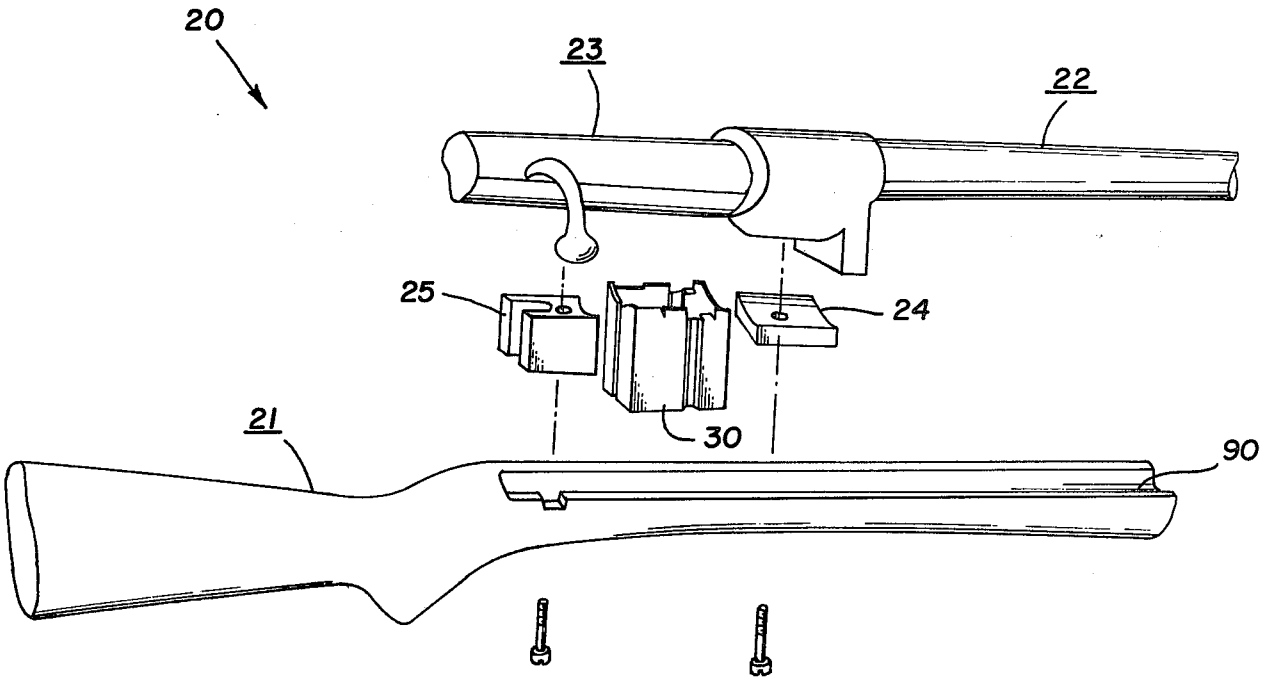
FIG. 1 is an exploded view in perspective showing a rifle stock, a rear portion of a rifle barrel, a receiver and bolt assembly connected with the rifle barrel, stock insert mounting blocks for supporting the receiver in the stock, and a magazine to contain and supply cartridges to the receiver.
Figure 2:
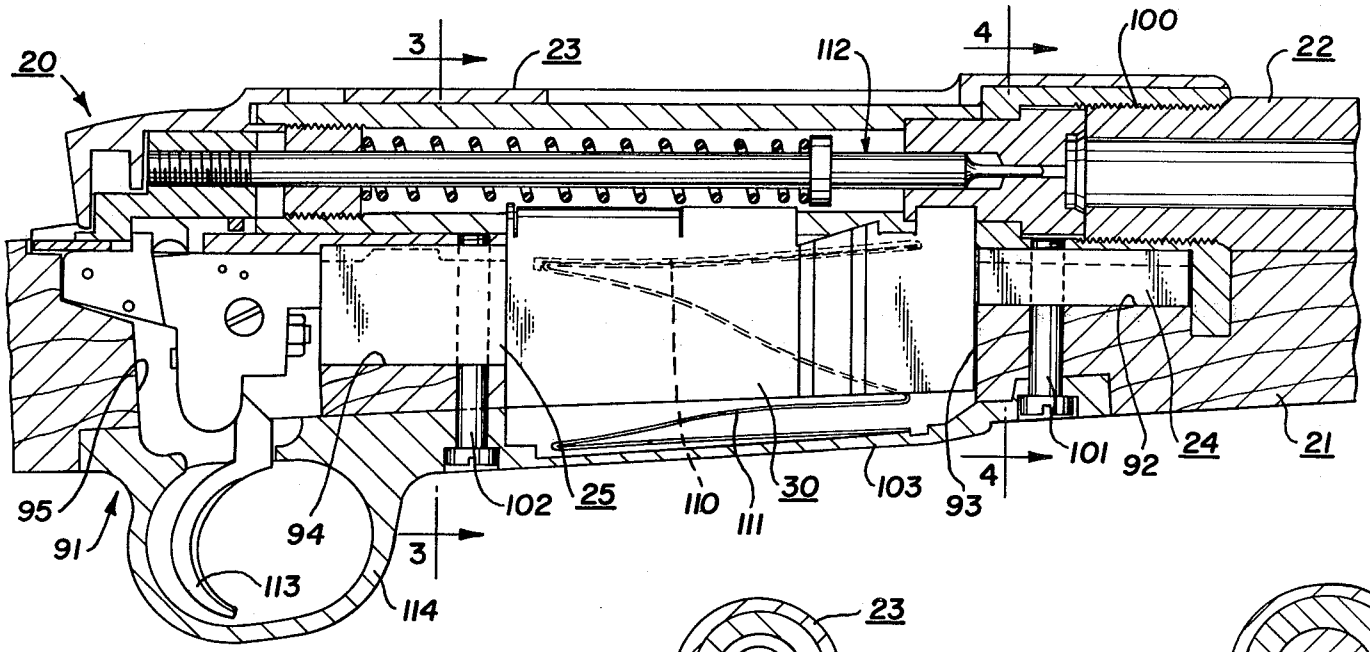
FIG. 2 is an enlarged fragmentary view in section showing the receiver, the rear end of a rifle barrel connected into the receiver, a central portion of the rifle stock, a trigger assembly mounted in the stock connected with the receiver, a magazine, and the mounting blocks for supporting the receiver in the stock.
Figure 3:
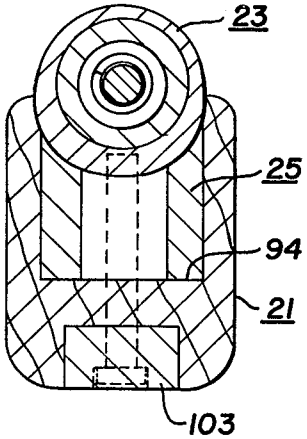
FIG. 3 is a view in section along the line 3—3 of FIG. 2 showing in detail the rear mounting block supporting the rear of the receiver in the stock.
Figure 4:
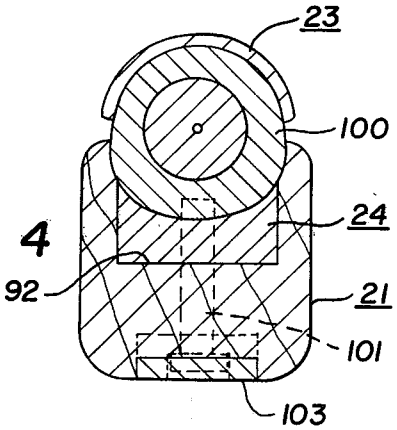
FIG. 4 is a view in section along the line 4—4 of FIG. 2 showing the front mounting block supporting the front of the receiver in the stock.

Referring to FIG. 1 of the drawings, a rifle 20 having the features of the invention includes a rifle stock 21, a rifle barrel 22, a receiver 23 connected with the rear end of the barrel, a forward mounting block 24 for supporting the forward end of the receiver and the rear end of the barrel in the stock, a rear mounting block 25 for supporting the rear end of the receiver in the stock, and a magazine 30 for containing and feeding rifle cartridges to the receiver. The mounting blocks permit a round barrel and receiver assembly to be mounted in a stock and the rifle used without applying undue damaging stresses to the stock. The use of the mounting blocks also permits the barrel and receiver to be rigidly clamped with the stock without distortion of the rifle parts. The magazine is a separate integral sheet material member which may be manufactured at minimum costs in contrast with the usual rails and loading ramp which normally are formed by hand in the receiver thereby substantially increasing rifle manufacturing costs. More specific details of the relationships between the mounting blocks, the magazine, and other parts of the rifle are shown in FIG. 2.

Figure 5:
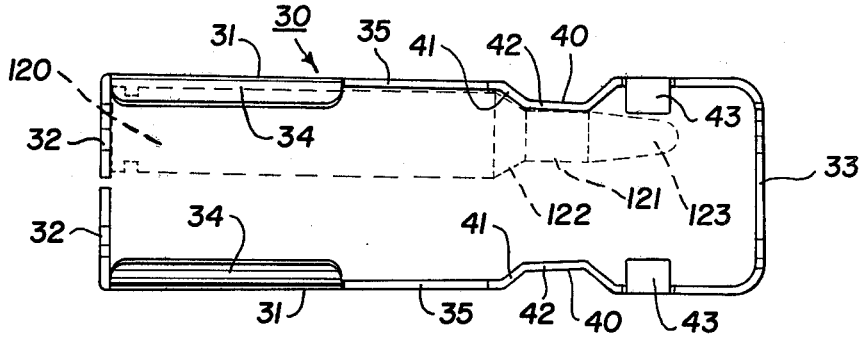
FIG. 5 is a top plan view of the magazine shown in FIGS. 1 and 2.
Figure 6:
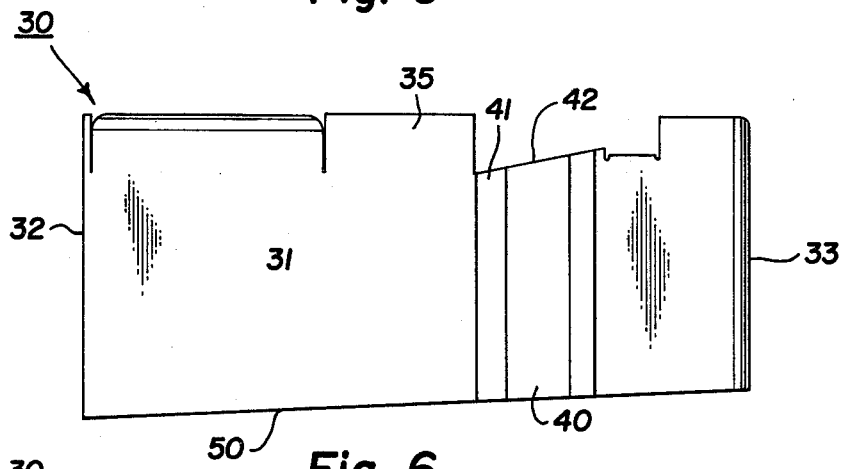
FIG. 6 is a side view in elevation of the magazine.
Figure 7:
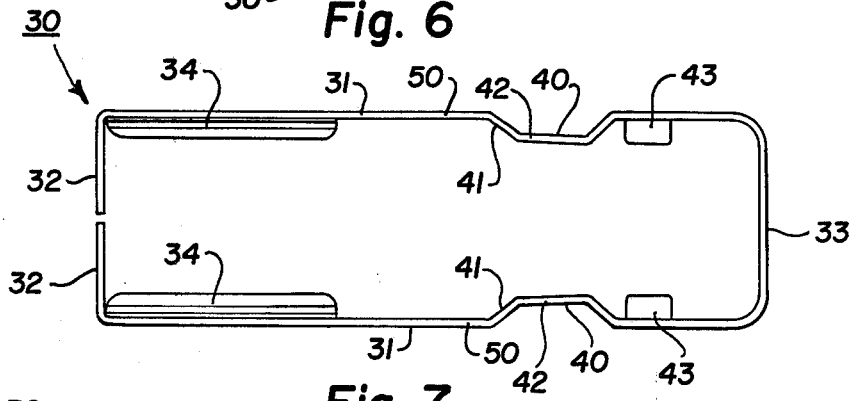
FIG. 7 is a bottom plan view of the magazine.
Figure 8:
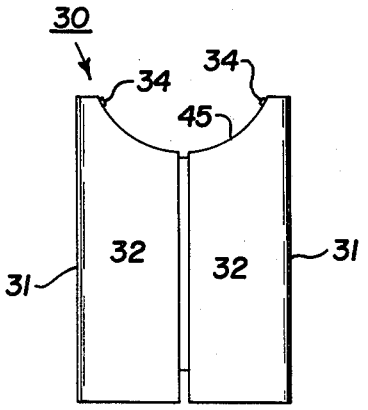
FIG. 8 is a rear end view of the magazine.
Figure 9:
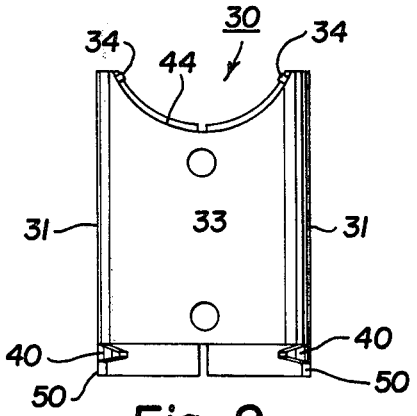
FIG. 9 is a front end view of the magazine.

Referring to FIGS. 5–9, the magazine 30 has identical opposite walls 31, a rear end wall defined by flange portions 32 formed integral with the rear end edges of the side walls 31, and a forward wall 33 joining the forward ends of the side walls. Each of the side walls has a cartridge case retainer flange 34 defined by a longitudinal inwardly curved upper rear end portion of each side wall. In cross section the retainer flanges 34 are curved upwardly and inwardly for holding cartridges in staggered side-by-side relationship within the magazine with the retainer flanges serving to hold the uppermost cartridge in each row within the magazine. The opposite ends of each of the retainer flanges 34 are curved as seen in FIGS. 5–7. The retainer flanges are long enough to engage a major portion of the length of the body of the cartridges within the magazine. Each of the side walls 31 has a vertical upper edge portion 35 positioned forward of the retainer flanges 34. The top edge of each of the straight side wall portions 35 is in alignment with the top edges of the forward and rear walls of the magazine. Each of the side walls 31 is deformed or bent inwardly along the forward vertical portion forming an inwardly projecting boss 40 defining a cartridge case shoulder engaging surface 41. The vertically extending inwardly deformed side wall portion 40 is cut down at an angle relative to the top edge of the side wall portion 35 extending forwardly and upwardly defining a cartridge case guide surface 42 which is engageable by a shoulder on a cartridge case for guiding the cartridge case upwardly and inwardly into proper position for loading in the rifle receiver as the cartridge case is driven forwardly out of the magazine into the receiver. An inwardly bent tab 43 is formed integral on the upper edge of each of the side walls of the magazine between the side wall portion 40 and the forward wall 33 providing an upper stop for a follower illustrated and described in connection with FIG. 2 which urges the cartridges within the magazine upwardly into the receiver. The forward wall 33 has a concave upper edge 44 formed on a radius substantially equal to the radius of the receiver. Similarly the rear wall portions 32 have concave upper edge surfaces 45 also formed on substantially the same radius as the receiver so that the magazine fits closely with the bottom of the receiver when in use. The bottom edge 50 of each of the magazine side walls 31 slopes upwardly and forwardly from the rear wall to the forward wall of the magazine to conform the shape of the bottom of the magazine to the upward slope of the stock and trigger mechanism as seen in FIG. 2.

The magazine 30 is preferably constructed of a strong, light weight metal which may be economically manufactured such as by stamping a pattern out of the sheet material and forming it to the magazine shape as by using a die in a hydraulic press. This is a substantially less expensive manner of providing the necessary cartridge retaining and guiding means than hand forming the required features in the receiver.

Figure 10:
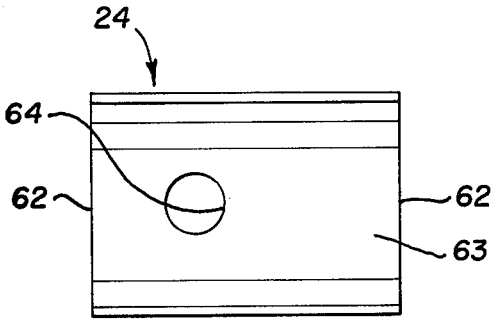
FIG. 10 is a top plan view of the front mounting block between the rifle stock and the front end of the receiver.
Figure 11:
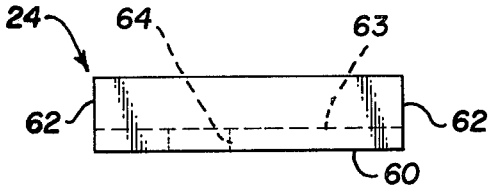
FIG. 11 is a side view in elevation of the front mounting block.
Figure 12:
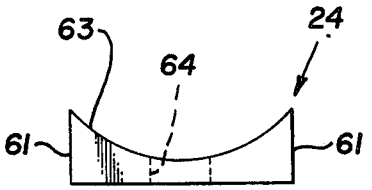
FIG. 12 is an end view in elevation of the front mounting block.
Figure 13:
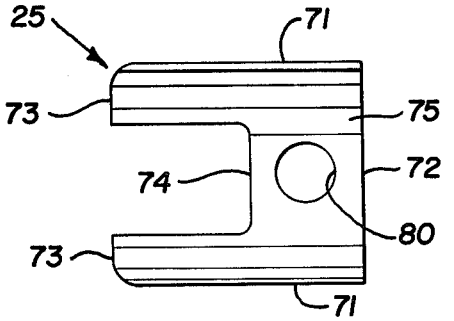
FIG. 13 is a top plan view of the rear mounting block.
Figure 15:
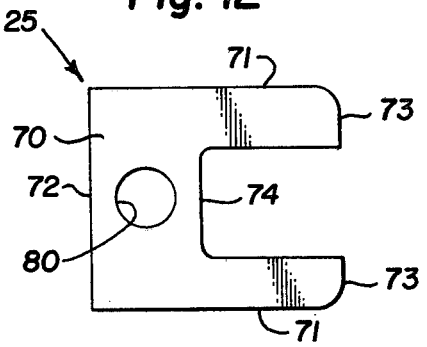
FIG. 15 is a bottom plan view of the rear mounting block.
Figure 14:
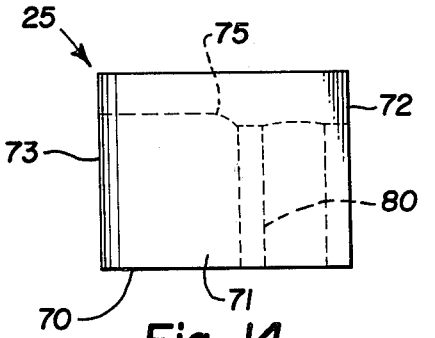
FIG. 14 is a side view in elevation of the rear mounting block.
Figure 16:
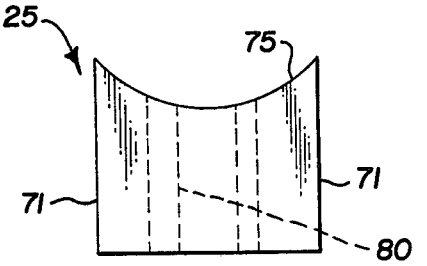
FIG. 16 is a front end view in elevation of the rear mounting block.

The front barrel and receiver mounting insert 24 shown in FIGS. 10–12 is a one piece integral member formed of a suitable material such as metal. The insert has a bottom 60, opposite side edge surfaces 61, and opposite end edge surfaces 62. The opposite side edge surfaces 61 are parallel with each other and perpendicular to the bottom surface 60. The end surfaces 62 are parallel with each other and perpendicular to both the side edge surfaces 61 and the bottom 60. The front stock insert or mounting block 24 has a top surface 63 which is a cylindrical surface portion formed on a radius along an axis substantially equal to that of the forward end of the receiver as illustrated in FIG. 2. A screw hole 64 is formed through the stock insert 24 perpendicular to the bottom surface 60 for a mounting bolt or screw to secure the stock insert and receiver with the rifle stock 21.

The rear receiver mounting block or stock insert 25 is illustrated in FIGS. 13–16. The stock insert 25 has a bottom surface 70, opposite side surfaces 71, a front end surface 72, and rear end surfaces 73 on opposite sides of a rearwardly opening vertical slot 74 for part of the rifle trigger assembly. The sides 71 are parallel with each other and perpendicular to the bottom surface 70. The opposite end surfaces 72 and 73 are spaced parallel surfaces aligned perpendicular to both the bottom surface 70 and the opposite side surfaces 71. The stock insert 25 has a concave top surface 75 which is formed on a radius substantially equal to the radius of the receiver 23 along a longitudinal axis perpendicular to the opposite end surfaces of the insert so that the receiver 23 is supported on the supporting surface 75. The insert 25 has a screw hole 80 for a screw or bolt securing the stock insert and the receiver with the stock 21. The stock inserts are manufactured of a metal or other suitable rigid material for supporting the receiver in the stock.

FIG. 2 illustrates the relationships between the magazine 30, the stock inserts 24 and 25, the barrel 22 and the receiver 23, and the stock 21. The stock 21, as shown in FIG. 1, has a longitudinal recess 90 in which the base end of the barrel 22, the receiver 23, the stock inserts 24 and 25, the magazine 30, and a trigger assembly 91 all fit in the assembled relationship represented in FIG. 2. The longitudinal recess 90 has a rectangular pocket portion 92 to accommodate the stock insert 24, a vertical chamber portion 93 opening through the bottom of the stock for the magazine 30, a rectangular pocket portion 94 for the stock insert 25, and a portion 95 which opens through the bottom of the stock at the rear end of the recess 90 for the trigger assembly. The rear end of the barrel 22 is threaded into a coupling member 100 which is cylindrical in shape and pressed into the forward end of the receiver 23. The external cylindrical surface of the forward end of the receiver matches the concave top surface 63 of the front stock insert 24 so that the front end of the receiver is supported on and secured to the stock insert 24. A bolt or screw 101 extends through the forward end of the trigger plate 103 of the trigger assembly, the portion of the stock 21 below the screw hole 64 of the stock insert 24 into the lower portion of the receiver for tightly securing the receiver on the insert 24 with rests within the stock pocket 92. The rear end portion of the receiver 23 is secured on the cylindrical surface portion 75 of the rear stock insert 25 by an externally threaded bolt or screw 102 extending through the rear portion of the trigger plate 103, the portion of the stock forming the floor of the pocket 94 and into the lower portion of the rear end of the receiver 23 which is supported in the insert 25 as shown in FIG. 2. The rectangular shape of the side and bottom portions of the front and rear stock inserts 24 and 25 fitting within the rectangular pockets 92 and 94 of the stock permit the mounting of the rear end of the barrel and the receiver in the stock without the usual radial forces between the stock and the barrel and receiver which are characteristic of conventional mounting arrangements. Such conventional structures cause radially outwardly extending forces from the barrel and receiver to eventually split the stock. The independent mounting of the forward and rear portions of the receiver and the rear end of the barrel by the stock inserts permits rigidly clamping the receiver and barrel with the stock without distortions which often occur when the receiver and barrel are directly clamped with the stock. Such distortions can affect the alignment of the barrel which in turn affects the consistent accuracy of the rifle.

The magazine 30 is supported within the stock chamber 93 by the trigger plate 103. A conventional follower 110 with a follower spring 111 are mounted with the magazine for supporting cartridges, not shown, and urging the cartridges upwardly in the magazine to the proper positions for sequentially loading each cartridge into the firing chamber by means of the bolt and firing pin assembly 112. The bolt and firing pin assembly 112 is connected with the trigger assembly 91 both of which are conventional in design and form no part of the present invention. The trigger assembly 91 includes the trigger 113 coupled with the bolt assembly in the usual manner and a trigger guard 114 which is formed integral with the trigger plate 103. The bolts 101 and 102 hold the trigger plate and the trigger assembly in the proper position in the stock.

The magazine 30 opens upwardly into the receiver for discharging cartridges such as the cartridge 120 as shown in FIG. 5 into the receiver for engagement by the bolt and movement into the chamber into a firing position. The open bottom of the magazine 30 is closed by the trigger plate 103. Cartridges are loaded in the normal manner through an opening, not shown, in the side of the receiver and pressed downwardly into the magazine against the follower 110 which moves downwardly as the cartridges are loaded compressing the follower spring 111. The cartridges fit in the magazine in alternate staggered positions with the uppermost cartridge in each of the vertical rows being engageable with the retainer flanges or lips 34 along the top edge of the rear of the magazine as the cartridge is moved upwardly by the force of the spring. The rifle bolt engages the rear end of the cartridge forcing it forward beneath the retainer flange 34 with the cartridge case neck 121 and the shoulder 122 at the base of the cartridge case neck engaging the guide surface 42 on the adjacent side of the magazine as the cartridge moves forward. The coaction between the guide surface 42 and the cartridge case shoulder 122 directs the cartridge upwardly and inwardly toward the center of the magazine into the receiver. When the rear end of the cartridge is pushed beyond the retainer lip 34 the follower 110 moves the cartridge fully upwardly and centrally of the receiver where the cartridge is forced into the firing chamber by the bolt. The lugs 43 on the opposite sides of the magazine limit the upward movement of the follower 110. The cartridge illustrated in FIG. 5 occupies the left side of the magazine in relation to the operator of the rifle while similarly a row of cartridges, not shown, are aligned vertically in staggered fashion on the right side of the magazine. The lip 34 and the guide surface 42 on the right side of the magazine perform the similar function of directing the cartridge upwardly and centrally of the magazine as the bolt pushes the cartridge forward toward the firing chamber at the base end of the barrel. The combined action of the magazine surfaces 41 and the opposite sides of the magazine and the top guide surface 42 direct the cartridge upwardly and inwardly in the magazine without any mechanical contact with the bullet 123 in the cartridge case. In some conventional rifle designs the loading ramp used is engaged by the bullet thereby causing some damage to the bullet which can affect its flight after firing. The particular design of the magazine 30 causes the cartridge to be guided to the proper firing position by engagement only with the cartridge case. The magazine design provides features which fully house and properly guide the cartridge without the necessity of machining any such features into the receiver which, as previously discussed, normally must be done by hand which is an expensive and some times less accurate technique.

I claim:

1. A rifle magazine adapted to be mounted in a rifle having a receiver, said magazine being at a position in said rifle opening into said receiver of said rifle and comprising: opposite spaced substantially parallel side walls; a rear end wall secured along opposite side edges with rear end edges of said side walls; a forward end wall parallel with said rear end wall and perpendicular with said side walls secured along opposite side edges with forward end edges of said side walls; a cartridge shell case retainer flange along the top edge of the rear portion of each of said side walls; an internal cartridge case retainer boss across each side wall forward of and perpendicular to said retainer flanges; and an upwardly and forwardly sloping top guide edge surface on each of said side walls along each of said retainer bosses for guiding cartridge cases upwardly and inwardly as said cartridge cases are moved toward said forward wall from said retainer flanges.

2. A rifle magazine in accordance with claim 1 wherein said magazine includes an internal follower retainer lug across the top edge of each of said side walls between said guide surface and said forward wall.

3. A rifle magazine in accordance with claim 2 wherein the bottom side wall edges slope upwardly from said rear wall to said forward wall.

4. A rifle magazine in accordance with claim 3 wherein each of said side walls has a central vertical upper portion between said retainer flange and said guide edge along said side wall, said central vertical portion having an upper edge above said retainer flange of said side wall.

5. A rifle magazine in accordance with claim 4 wherein said magazine is formed of sheet material as an integral one piece member.

6. A rifle magazine in accordance with claim 5 wherein said sheet material is metal.

7. A rifle magazine in accordance with claim 4 wherein said rear wall and said forward wall each has a concave upper edge surface formed on a radius substantially equal to the radius of the adjacent portion of said rifle receiver.

* * * * *